US009256186B2

(12) United States Patent
Kume et al.

(10) Patent No.: US 9,256,186 B2
(45) Date of Patent: Feb. 9, 2016

(54) IMAGE FORMING APPARATUS

(71) Applicant: CANON KABUSHIKI KAISHA, Tokyo (JP)

(72) Inventors: Takao Kume, Yokohama (JP); Yusuke Shimizu, Yokohama (JP); Kenichi Iida, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/526,940

(22) Filed: Oct. 29, 2014

(65) Prior Publication Data

US 2015/0117892 A1 Apr. 30, 2015

(30) Foreign Application Priority Data

Oct. 29, 2013 (JP) ..... 2013-224716

(51) Int. Cl.

*G03G 15/20* (2006.01)
*G03G 15/00* (2006.01)
*G03G 15/16* (2006.01)

(52) U.S. Cl.

CPC ..... *G03G 15/80* (2013.01); *G03G 15/1605* (2013.01); *G03G 15/2003* (2013.01); *G03G 15/2078* (2013.01); *G03G 15/5004* (2013.01); *G03G 2215/00983* (2013.01); *G03G 2215/0129* (2013.01); *G03G 2215/1642* (2013.01)

(58) Field of Classification Search

CPC ..... G03G 15/50
USPC ..... 399/88
See application file for complete search history.

(56) References Cited

U.S. PATENT DOCUMENTS

| | | | | |
|---|---|---|---|---|
| 5,508,879 | A | 4/1996 | Kitamura et al. | |
| 6,434,349 | B1 * | 8/2002 | Shimizu et al. | 399/100 |
| 6,668,154 | B2 * | 12/2003 | Dickhoff | 399/388 |
| 7,139,519 | B2 * | 11/2006 | Darcy et al. | 399/302 |
| 8,135,319 | B2 * | 3/2012 | Fujita | 399/316 |
| 8,326,193 | B2 * | 12/2012 | Suzuki et al. | 399/296 |
| 2001/0051055 | A1 * | 12/2001 | Omata et al. | 399/66 |
| 2003/0113141 | A1 * | 6/2003 | Saito et al. | 399/302 |
| 2003/0123910 | A1 * | 7/2003 | Kim et al. | 399/296 |
| 2004/0096236 | A1 * | 5/2004 | Shin | 399/88 |

(Continued)

FOREIGN PATENT DOCUMENTS

| | | | | |
|---|---|---|---|---|
| JP | 5-127546 A | | 5/1993 | |
| JP | H05127546 | * | 5/1993 | G03G 15/16 |

(Continued)

*Primary Examiner* — Clayton E Laballe
*Assistant Examiner* — Kevin Butler
(74) *Attorney, Agent, or Firm* — Fitzpatrick, Cella, Harper & Scinto

(57) ABSTRACT

An image forming apparatus includes: an image bearing member for bearing a toner image; a belt for transferring the toner image from the image bearing member onto a transfer material; an electric power supplying device, contacted to the belt, to which a voltage is to be applied, wherein the electric power supplying device includes an erected fiber portion formed with a plurality of electroconductive erected fibers contacted to the belt; a power source; and a contact member, connected to the electric power supplying device, for applying the voltage from the power source to the electric power supplying device. The electric power supplying device includes a welded portion formed by heat aggregation of a part of the erected fiber portion, and the contact member is connected to the welded portion.

15 Claims, 6 Drawing Sheets

(56) References Cited

U.S. PATENT DOCUMENTS

| | | | | |
|---|---|---|---|---|
| 2006/0177245 | A1* | 8/2006 | Hamada et al. | 399/296 |
| 2006/0177248 | A1* | 8/2006 | Takiguchi et al. | 399/313 |
| 2006/0239725 | A1* | 10/2006 | Kimura et al. | 399/296 |
| 2009/0202279 | A1* | 8/2009 | Saito et al. | 399/297 |
| 2009/0214273 | A1* | 8/2009 | Ue | 399/302 |
| 2011/0085810 | A1* | 4/2011 | Choi | 399/45 |

FOREIGN PATENT DOCUMENTS

| | | | | | |
|---|---|---|---|---|---|
| JP | 7-73992 | A | | 3/1995 | |
| JP | 7-84434 | A | | 3/1995 | |
| JP | 7-110625 | A | | 4/1995 | |
| JP | 2002-91134 | A | | 3/2002 | |
| JP | 2007-086541 | | * | 4/2007 | G03G 15/00 |
| JP | 2007-86541 | A | | 4/2007 | |
| JP | 2011-248385 | A | | 12/2011 | |

* cited by examiner

IMAGE FORMING APPARATUS

FIELD OF THE INVENTION AND RELATED ART

The present invention relates to an image forming apparatus of an electrophotographic type, an electrostatic recording type or the like.

In a conventional image forming apparatus of the electrophotographic type, an image is formed by utilizing an electrostatic action by an electric power supplying device. As the electric power supplying device, a charging device for electrically charging a photosensitive member as an image bearing member and a transfer device for transferring a toner image from the photosensitive member as the image bearing member or from an intermediary transfer member onto a transfer-receiving member are used. Further, it is also possible to use a toner charging device for supplying electric charges to a toner on the photosensitive member or the intermediary transfer member, a cleaning member for removing the toner on the photosensitive member or the intermediary transfer member, and a discharging (charge-removing) member for removing the electric charges from the photosensitive member.

As these electric power supplying devices to which a high-voltage is to be applied, those including, as an electric power supplying member, an electroconductive roller, an electroconductive blade, an electroconductive sheet and an electroconductive brush. Of these electric power supplying devices, the electric power supplying device including a brush-shaped electric power supplying member (electroconductive brush) having an erected fiber portion formed with electroconductive erected fibers is excellent in sliding property and is comparatively inexpensive, and in addition, has a feature inherent in fibers.

For example, in Japanese Laid-Open Patent Application (JP-A) Hei 5-127546, a transfer device including the brush-shaped electric power supplying member, as a transfer member (transfer brush) is disclosed. In the transfer device disclosed in JP-A Hei 5-127546, the transfer brush is contacted by a group of electroconductive fibers, and therefore each of the electroconductive erected fibers is independently contactable with a back surface of the transfer-receiving member such as an intermediary transfer belt. Accordingly, the transfer device has the feature such that contact non-uniformity generated in the case where a roller-shaped or blade-shaped transfer member is used is improved and thus a uniform contact property with the back surface of the transfer-receiving member can be obtained.

Further, in JP-A 2011-248385, as a method of applying a transfer voltage to the transfer brush, a method in which respective erected fibers constituting the transfer brush are fixed on an electroconductive supporting member by an electroconductive double-side tape and then electric power is supplied to the transfer brush via the electroconductive supporting member is disclosed.

However, it is known that the method, disclosed in JP-A 2011-248385, in which the fibers are fixed by the electroconductive double-side tape is relatively expensive and is weak in adhesive property compared with an ordinary double-side tape to which electroconductivity is not imparted. For that reason, depending on an operation (use) state, there is a liability that each of the erected fiber portions is peeled off from the electroconductive supporting member and that a bonding position is deviated.

SUMMARY OF THE INVENTION

Accordingly, a principal object of the present invention is to provide an image forming apparatus, including an electric power supplying device to be contacted to an object at an erected fiber portion thereof formed with a plurality of electroconductive fibers, of stably applying a voltage to the electric power supplying device.

These and other objects, features and advantages of the present invention will become more apparent upon a consideration of the following description of the preferred embodiments of the present invention taken in conjunction with the accompanying drawings.

DESCRIPTION OF THE EMBODIMENTS

With reference to the drawings, an electric power supplying device, an image forming apparatus and a manufacturing method of the electric power supplying device in the present invention will be exemplarily described specifically below.

(Embodiment 1)

1. General Structure and Operation of Image Forming Apparatus

Figure 1:
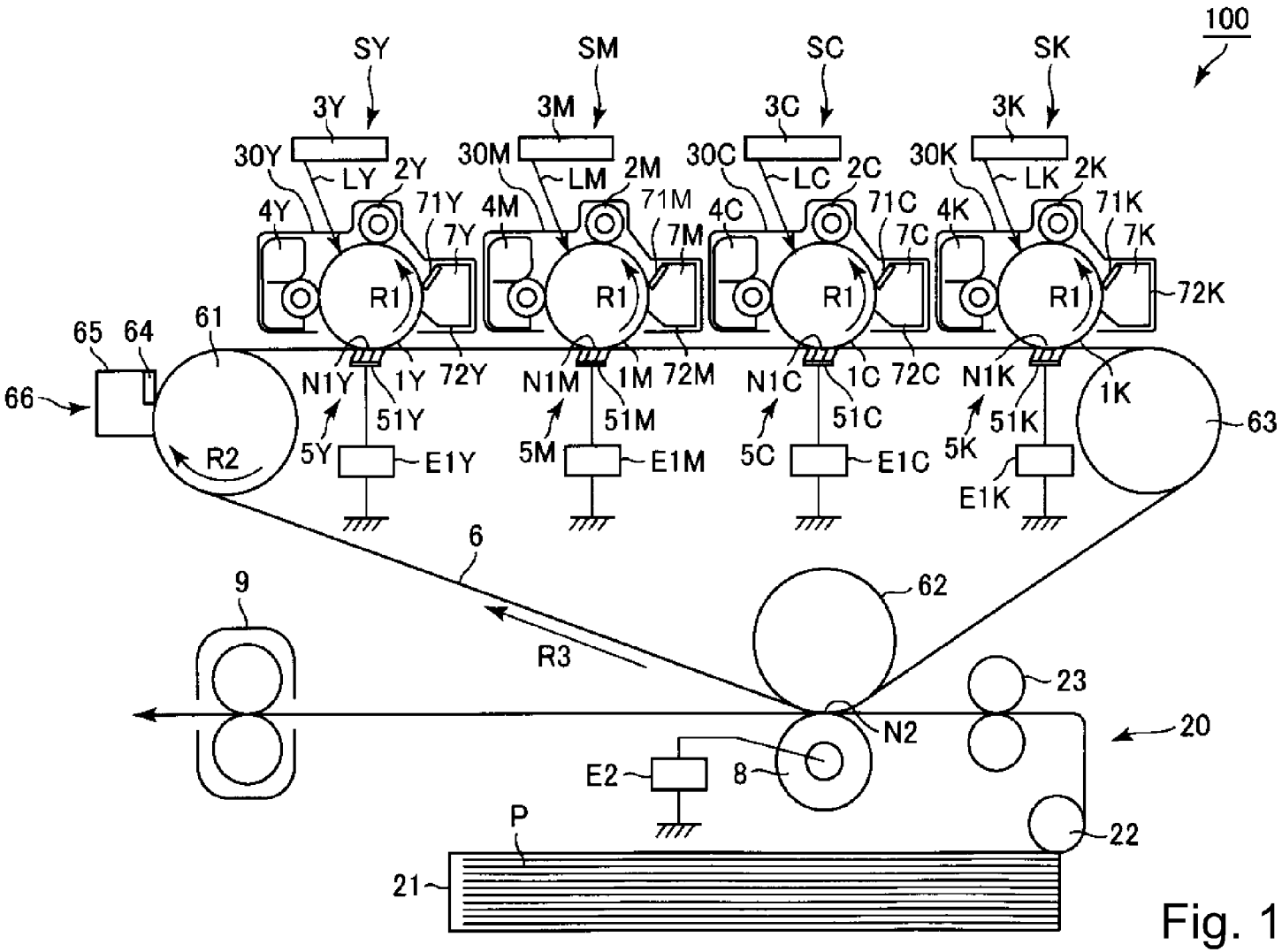
FIG. 1 is a schematic sectional view of an image forming apparatus.

FIG. 1 is a schematic sectional view showing a general structure of an image forming apparatus 100 according to this embodiment of the present invention. The image forming apparatus 100 in this embodiment is a full-color laser beam printer capable of forming a full-color image using an electrophotographic type, and employs an intermediary transfer type and a tandem type. That is, in the image forming apparatus 100 in this embodiment, toner images of a plurality of colors each formed in accordance with image information separated into a plurality of color components are successively primary-transferred superposedly onto an intermediary transfer member and thereafter are collectively secondary-transferred onto a transfer material to obtain a recording image.

The image forming apparatus 100 includes, as a plurality of image forming portions, first to fourth stations (image forming portions) Sa, Sb, Sc and Sd. The first to fourth stations Sa, Sb, Sc and Sd form toner images of yellow (Y), magenta (M), cyan (C) and black (K), respectively. Constitutions and operations of the respective stations Sa to Sd are the substantially same except that the colors of the toners used are different from each other. Accordingly, in the following, in the case where there is no need to particularly distinguish the stations, description will be made by omitting suffixes, Y, M, C and K for representing elements provided for associated colors, and the elements will be collectively described.

The image forming apparatus 100 includes a photosensitive drum 1, which is a drum-type (cylindrical) electrophotographic photosensitive member, as an image bearing member in the station S. The photosensitive drum 1 is rotationally driven in an arrow R1 direction (counterclockwise direction), indicated in FIG. 1, by a driving means (not shown). A surface of the rotating photosensitive drum 1 is electrically charged substantially uniformly by a charging roller 2 which is a roller-shaped charging member as a charging means. Then, the charged surface of the photosensitive drum 1 is irradiated with laser light L, in accordance with the image information, emitted from an exposure device 3, so that an electrostatic latent image (electrostatic image) is formed. When the electrostatic latent image formed on the surface of the photosensitive drum 1 reaches a developing position, which is an opposing portion to a developing device 4 as a developing means, with the rotation of the photosensitive drum 1, the electrostatic latent image is developed (visualized) as a toner image with the toner as a developer by the developing device 4. In this embodiment, the developing device 4 develops the electrostatic latent image on the photosensitive drum 1 by a reverse development method. That is, the developing device 4 develops the electrostatic latent image by depositing, on an image portion (exposed portion) on the photosensitive drum 1 lowered in absolute value of potential by being exposed to light after being charged substantially uniformly, a toner charged to the same polarity (negative) as a charge polarity (negative in this embodiment) of the photosensitive drum 1.

With respect to a movement direction of the surface of the photosensitive drum 1, an intermediary transfer belt 6 as the intermediary transfer member is provided downstream of the developing position. The intermediary transfer belt 6 is stretched by three rollers consisting of a driving roller 61, a secondary transfer opposite roller 62 and a tension roller 63. The intermediary transfer belt 6 is constituted by a cylindrical and endless film in a state before being stretched by these rollers. The intermediary transfer belt 6 is rotated (circulated and moved) in an arrow R3 direction (clockwise direction) substantially at the same speed as a surface movement speed of the photosensitive drum 1 by rotationally driving the driving roller 61 in an arrow R2 direction (clockwise direction).

In a position opposing the photosensitive drum 1 via the intermediary transfer belt 6, a primary transfer device 5 as a primary transfer means is provided. The primary transfer device 5 is an electric power supplying device to which a high-voltage is to be applied from a primary transfer power source E1, and includes a primary transfer brush 51 as a primary transfer member which is a brush-shaped electric power supplying member including an erected fiber portion formed with electroconductive fibers. The primary transfer brush 51 is urged against the intermediary transfer belt 6 toward the photosensitive drum 1 to form a primary transfer portion (primary transfer nip) N1 where the photosensitive drum 1 and the intermediary transfer belt 6 are in contact with each other. With rotation of the photosensitive drum 1 and the intermediary transfer belt 6, the toner image formed on the photosensitive drum 1 is primary-transferred onto an outer peripheral surface of the intermediary transfer belt 6 by the action of the primary transfer brush 51. At this time, to the primary transfer brush 51, a primary transfer voltage (primary transfer bias) of an opposite polarity (positive in this embodiment) to a toner charge polarity (normal charge polarity) during the development is applied from a primary transfer power source E1.

In a primary transfer step, a transfer residual toner remaining on the photosensitive drum 1 without being transferred onto the intermediary transfer belt 6 is removed by a drum cleaning 7 as a photosensitive member cleaning device. The drum cleaner 7 includes a cleaning blade 71 as a plate-like elastic member contacted to the surface of the photosensitive drum 1. Further, the photosensitive drum cleaner 7 includes a residual toner container 72 for collecting the transfer residual toner removed from the surface of the photosensitive drum 1 by the cleaning blade 71.

For example, during formation of a full-color image, the above-described steps of charging, exposure, development and primary transfer are successively performed from an upstream side of the movement direction of the surface of the intermediary transfer belt 6 in the order of the first to fourth stations Sa, Sb, Sc and Sd, respectively. As a result, on the intermediary transfer belt 6, multiple toner images obtained by successively superposing four color toner images of yellow, magenta, cyan and black are formed.

In a position opposing the secondary transfer opposite roller 62 via the intermediary transfer belt 6, a secondary transfer roller 8 which is a roller-type secondary transfer member as a secondary transfer means is provided. The secondary transfer roller 8 is urged against the intermediary transfer belt 6 toward the secondary transfer opposite roller 62 to form a secondary transfer portion (secondary transfer nip) N2 where the intermediary transfer belt 6 and the secondary transfer roller 8 are in contact with each other. The toner images on the intermediary transfer belt 6 are secondary-transferred onto the transfer material P by the action of the secondary transfer roller 8. That is, at a temperature feeding portion 20, the transfer material P accommodated in a cassette 21 is fed by a feeding roller 22 and thereafter is supplied, at predetermined timing by a registration roller pair 23, to the secondary transfer nip N2 where the intermediary transfer belt 6 and the secondary transfer roller 8 are in contact with each other. Substantially at the same time, to the secondary transfer roller 8, a secondary transfer voltage (secondary transfer bias) of an opposite polarity (positive in this embodiment) to the toner charge polarity during the development is applied from a secondary transfer power source E2.

The transfer material P on which the toner images are transferred is fed to a fixing device 9 as a fixing means, in which the toner images are heated and pressed and thus are fixed on the transfer material P. Thereafter, the transfer material P on which the toner images are fixed is discharged to an outside of the apparatus main assembly of the image forming apparatus 100.

At a position opposing the driving roller 61 via the intermediary transfer belt 6, a belt cleaner 66 as an intermediary transfer member cleaning means is provided. The transfer residual toner remaining on the intermediary transfer belt 6 without being transferred onto the transfer material P is removed by the belt cleaner 66. The belt cleaner 66 includes a cleaning blade 64 which is a plate-like elastic member contacted to the surface of the intermediary transfer belt 6. Further, the belt cleaner 66 includes a residual toner container 65 for collecting the toner residual toner removed from the surface of the intermediary transfer belt 6 by the cleaning blade 64.

Incidentally, the image forming apparatus 100 in this embodiment is a printer which has a process speed of 116 mm/s and which is compatible with A4-sized paper.

Further, in each of the image forming portions S, the photosensitive drum 1 and, as process means actable on the photosensitive drum 1, the charging roller 2, the developing device 4 and the drum cleaner 7 are integrally assembled into a process cartridge 30 detachably mountable to the apparatus main assembly of the image forming apparatus 100.

2. Intermediary Transfer Belt

As the intermediary transfer belt 6, a 60 μm-thick polyimide resin film adjusted to have a volume resistivity of $10^9$ Ωcm by mixing therein an electroconductive agent was used. Further, the intermediary transfer belt 6 is stretched by three shafts of the driving roller 61, the secondary transfer opposite roller 62 and the tension roller 63, and a tension of a total pressure of about 20 N is applied to the intermediary transfer belt 6 by the tension roller 63. Further, at widthwise end portions of the intermediary transfer belt 6, ribs for stabilizing feeding of the intermediary transfer belt 6 are provided.

3. Secondary Transfer Roller

As the secondary transfer roller 8, an elastic roller which is $10^7$-$10^9$ Ωcm in volume resistivity and 30-40 degrees in hardness (Asker rubber hardness meter of C-type) was used. The secondary transfer roller 8 is urged against the intermediary transfer belt 6 toward the secondary transfer opposite roller 62 at the total pressure of about 39.2 N. Further, the secondary transfer roller 8 is rotated by the rotation of the intermediary transfer belt 6. To the secondary transfer 8, from the secondary transfer power source E2, the secondary transfer voltage of 0-4.0 kV is applicable.

4. Basic Structure of Primary Transfer Device

Figure 2:
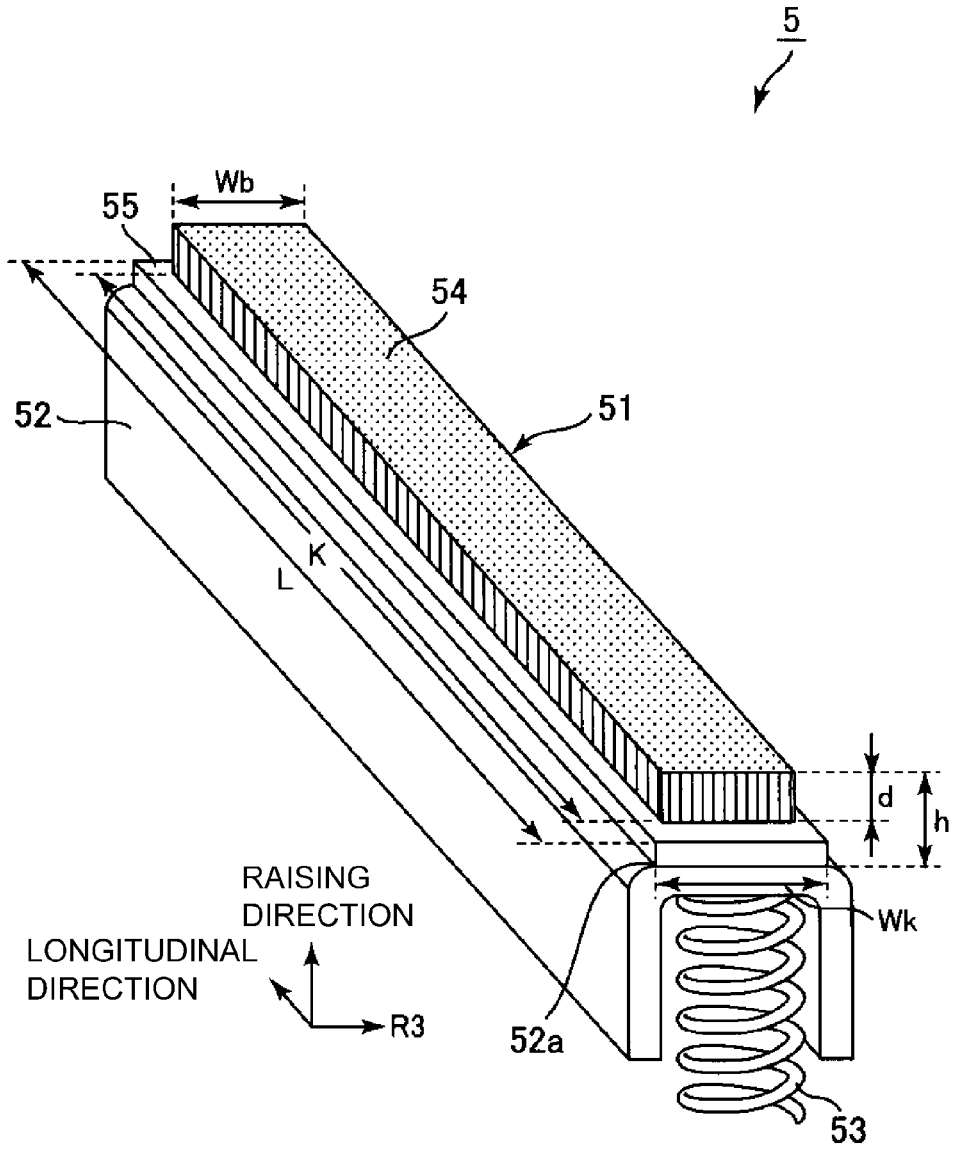
FIG. 2 is a schematic perspective view of a principal part of a primary transfer device before a welded portion is formed.

First, with reference to FIG. 2, a basic structure of the primary transfer device 5 in this embodiment will be described. FIG. 2 is a schematic perspective view of a principal part of the primary transfer device 5 before a welded portion, described later, of the primary transfer device 5 is formed. Incidentally, the structures of the primary transfer devices 5Y, 5M, 5C and 5K disposed correspondingly to the respective stations Sa to Sd are substantially the same. Accordingly, in the following, in the case where there is no need to particularly distinguish the primary transfer devices, description will be made by omitting suffixes Y, M, C and K for representing elements provided for associated colors, and the elements will be collectively described.

The primary transfer device 5 includes a primary transfer brush 51 as a brush-shaped electric power supplying member, a supporting member 52 for supporting the primary transfer brush 51, and an urging member 53 as an urging means for urging the primary transfer brush 51 toward the intermediary transfer belt 6 via the supporting member 52. The urging spring 53 is illustrated in FIG. 2 only at one longitudinal end portion of the primary transfer brush 51, but is also provided at the other longitudinal end portion of the primary transfer brush 51. The primary transfer device 5 further includes a contact member connected with the power source E1 for applying the voltage to the primary transfer brush 51, but this contact member will be specifically described later together with the above-mentioned welded portion.

The primary transfer brush (electroconductive brush) 51 is contacted by an erected fiber portion 54 consisting of a group of electroconductive erected fibers and a base cloth portion 55, consisting of non-electroconductive fibers, as a base portion for supporting the erected fiber portion 54. The base cloth portion 55 has a substantially rectangular sheet shape viewed in a plane. A surface of the base cloth portion 55 opposite from a surface of the base cloth portion 55 where the fibers of the erected fiber portion 54 are erected is fixed to a flat fixing surface 52*a* of the supporting member 52 by a double-side tape 500 (FIG. 4) as a fixing member. As a result, the electroconductive fibers of the erected fiber portion 54 of the primary transfer brush 51 are erected in a direction (normal direction) substantially perpendicular to the fixing surface 52*a* of the supporting member 52. That is, in this embodiment, an erecting direction of the erected fiber portion 54 of the primary transfer brush 51 is the direction normal to the base cloth portion 55 and the fixing surface 52*a* of the supporting member 52. The erecting direction refers to a direction in which in the primary transfer brush 51 in a state in which the primary transfer brush 51 is not contacted to a member-to-be-contacted (i.e., in a state in which a pressure is not applied to the fibers), the electroconductive erected fibers are extended and projected from the surface of the base cloth portion 55.

In this embodiment, a pile fabric in which the electroconductive erected fibers constituting the erected fiber portion 54 are woven in a fabric as the base cloth portion 55 and are tightly disposed is used as the primary transfer brush 51. A dimension Wb of the erected fiber portion 54 of the primary transfer brush 51 with respect to a short direction (substantially parallel to the movement direction of the intermediary transfer belt) is Wb=3 mm. Further, a dimension Wk of the base cloth portion 55 with respect to the short direction is Wk=5 mm. On the other hand, a dimension L of the base cloth portion 55 with respect to a longitudinal direction (substantially perpendicular to the movement direction of the intermediary transfer belt) is L=250 mm. Further, a dimension K of the erected fiber portion 54, of the primary transfer brush 51, including the welded portion described later is K=230 mm. Incidentally, the erected fiber portion 54 including the welded portion described later is disposed inside four sides of the base cloth portion 55.

In this embodiment, as the electroconductive erected fibers constituting the erected fiber portion 54, electroconductive nylon fibers in which carbon black powder was dispersed as an electroconductive agent was used. The electroconductive erected fibers may preferably be in ranges of 2-15 dtex (decitex) (which is a weight (g) per 10,000 m of filament) in filament fineness, 10-40 μm in diameter and 1-3 cN/dtex in dry strength. The electroconductive erected fibers may preferably be in a range of 10-$10^8$ Ωcm in fiber resistivity pfiber. The fiber resistivity pfiber is measured by the following method. First, 50 fibers are prepared in a bundle, and then a metal probe is contacted to a surface of the bundle of the fibers with an interval of about 1 cm. Thereafter, by using a high resistance meter (such as "R8340A", manufactured by Adventest Corp.), a resistance value Rfiber is actually measured at an applied voltage of 100 V, and then the fiber resistivity pfiber is calculated by the following equation:

$$\rho\text{fiber}=R\text{fiber}\times(\text{fiber diameter}/2)^2\times3.14\times50/1.0.$$

In this embodiment, a fiber length d of the primary transfer brush 51 was 1.5 mm. The fiber length d refers to a length of the electroconductive erected fibers from the base cloth portion 55 to a free end in a state in which the primary transfer brush 51 is not contacted to the member-to-be-contacted (in a state in which no pressure is applied to the fibers). In this embodiment, a brush height h obtained by adding the fiber length d to the thickness of the base cloth portion 55 is 2.0 mm.

A material for the fibers constituting the erected fiber portion 54 may be any material if electroconductivity is imparted to the material, and the fibers are not limited to the electroconductive nylon fibers.

In this embodiment, as described later, electric power is directly supplied from the side of the erected fiber portion 54 to the erected fiber portion 54 via the welded portion formed at a part of the erected fiber portion 54. Further, with respect to a longitudinal direction of the primary transfer brush 51, the electric power is supplied through the erected fiber portion 54 constituted by densely disposing the electroconductive fibers. In order to uniformly supply the electric power to the erected fiber portion 54 as a whole, a fiber density (the number of filaments per unit area: orientation density) of the electroconductive erected fibers of the erected fiber portion 54 may preferably be 20 KF/cm$^2$ or more, more preferably be 35 KF/cm$^2$ or more. However, for the reason of manufacturing or the like, in general, the fiber density of the electroconductive erected fibers of the erected fiber portion 54 is 80 KF/cm$^2$ or less.

Further, in this embodiment, as the fibers constituting the base cloth portion 55, non-electroconductive polyester fibers were used. However, the base cloth portion 55 may only be required to be a woven fabric capable of erecting the fibers by weaving the fibers of the erected fiber portion 54, and therefore a material for the fibers constituting the base cloth portion 55 may be any material, and the fibers are not limited to the non-electroconductive polyester fibers. However, from the viewpoint such that generation of unintended electric discharge between the base cloth portion 55 and the back surface of the intermediary transfer belt 6 when the voltage is applied to the primary transfer brush 51 can be suppressed, the fibers constituting the base cloth portion 55 may preferably have non-electroconductivity. The resistivity pfiber of the non-electroconductive erected fibers may preferably be $10^9$ Ωcm or more and is $10^{18}$ Ωcm or less in general.

As the primary transfer brush 51, a primary transfer brush having the following specification as representative characteristics was used.

<Specification of Primary Transfer Brush>

Member type: pile fabric

Material: nylon fibers in which carbon black power is dispersed

Fiber length (thickness): 1.5 mm

Width (short direction): 3.0 mm (erected fiber portion)

Fineness: 170T (decitex)/68 F

Filament fineness: 2.5 T

Resistivity: $10^{4.9}$ Ωcm

Fiber density (orientation density): 42 KF/cm$^2$

Figure 4:
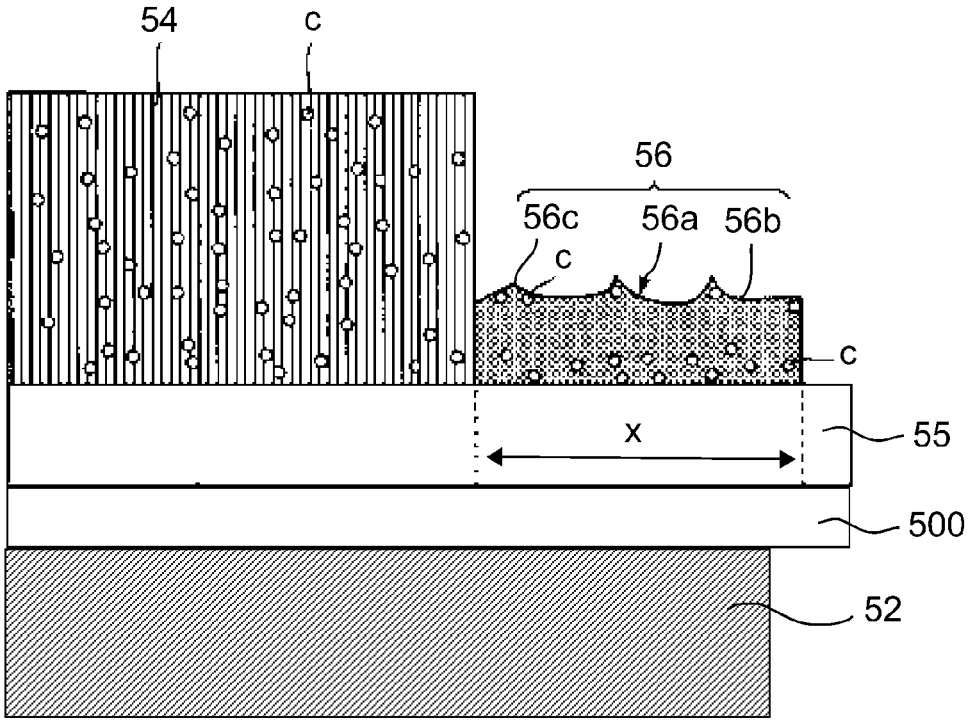
FIG. 4 is a schematic sectional view in the neighborhood of the welded portion of a primary transfer brush.

The above-described primary transfer brush 51 is fixed on the fixing surface 52*a* of the supporting member 52 by the double-side tape 500 so that the double-side tape 500 leaves a gap of 1 mm each at longitudinal end portions of the fixing surface 52*a* and at a downstream end portion with respect to the short direction of the fixing surface 52*a*. The double-side tape 500 schematically shown in FIG. 4 is a very thin member and is omitted from illustration in other figures.

The primary transfer brush 51 is contacted to the back surface of the intermediary transfer belt 6 at a position opposing the photosensitive drum 1 by the urging spring 53 via the supporting member 52. As a result, the erected fiber portion 54 of the primary transfer brush 51 is deformed, and a position where a restoring force of the erected fiber portion 54 and an urging force by the urging spring 53 are balanced with each other is a position of the primary transfer brush 51 with respect to an urging direction. At that position, the primary transfer brush 51 forms the primary transfer nip N1.

In this embodiment, the supporting member 52 is formed of a non-electroconductive synthetic resin material. In this embodiment, as described later, the electric power is directly supplied from the side of the erected fiber portion 54 to the erected fiber portion 54 via the welded portion formed at a part of the erected fiber portion 54, and therefore the supporting member 52 may also have no electroconductivity.

In a conventional constitution, there is a method in which a transfer brush is fixed on an electroconductive supporting member by an electroconductive double-side tape and then electric power is supplied to the transfer brush via the electroconductive supporting member. However, as described above, it has been known that the electroconductive double-side tape is relatively expensive and is weak in adhesive property compared with an ordinary double-side tape to which electroconductivity is not imparted. For that reason, it becomes difficult to peel the transfer brush from the electroconductive supporting member and then to bring the transfer brush into contact with the back surface of the belt uniformly. Further, depending on the adhesive property of the electroconductive double-side tape, in some cases, application non-uniformity (electric power supply non-uniformity) of the transfer voltage to the transfer brush is liable to generate. For that reason, it becomes difficult to obtain a desired transfer performance in the method in which the transfer brush is fixed on the electroconductive supporting member by the electroconductive double-side tape and then the electric power is supplied to the transfer brush via the electroconductive supporting member.

On the other hand, in this embodiment, the primary transfer brush 51 is fixed on the supporting member 52 by using the double-side tape (insulating tape) 500 to which the electroconductivity is not imparted. For that reason, compared with the case where the electroconductive double-side tape is used, the primary transfer brush 51 can be fixed firmly, so that it is possible to suppress a problem due to the above-described peeling.

5. Welded Portion and Contact Member

Figure 3:
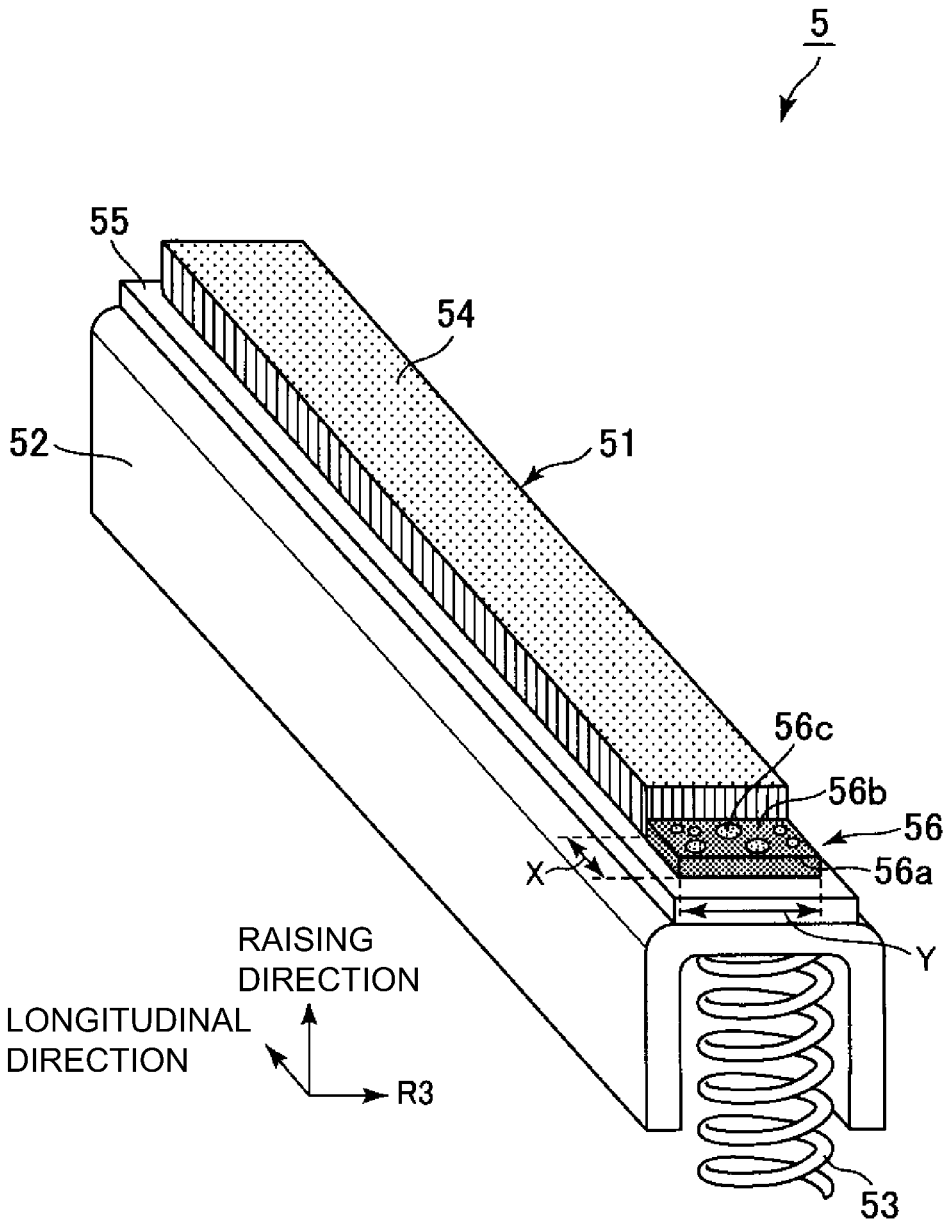
FIG. 3 is a schematic perspective view of a principal part of the primary transfer device after the welded portion is formed.
Figure 5:
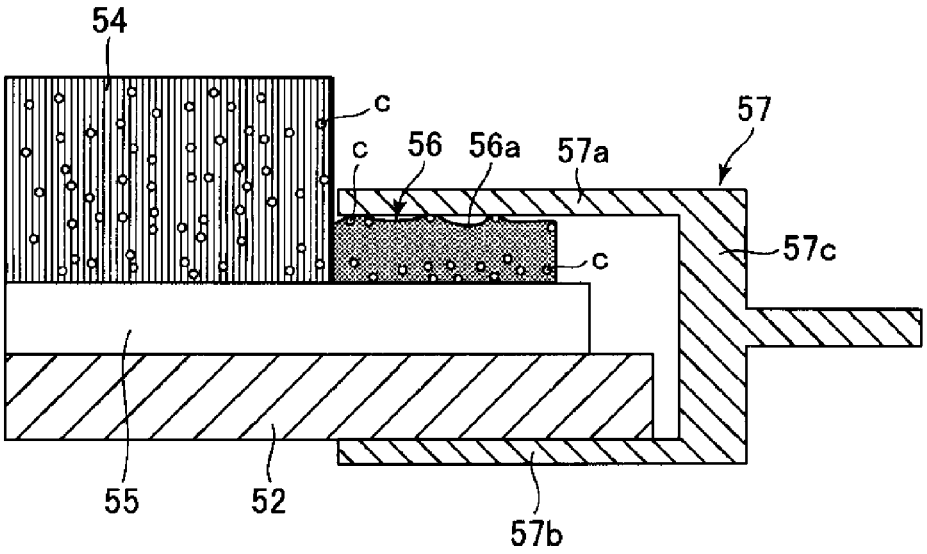
FIG. 5 is a schematic sectional view in the neighborhood of the welded portion of the primary transfer brush in a state in which a contact member is mounted.

With reference to FIGS. 3 to 5, the welded portion and the contact member which are provided in the primary transfer device 5 in this embodiment will be described. FIG. 3 is a schematic perspective view of a principal part of the primary transfer device 5 in a state after the welded portion described later is formed. FIG. 4 is a schematic sectional view of the primary transfer brush 51 in the neighborhood of the welded portion described later. FIG. 5 is a schematic sectional view of the primary transfer brush 51 in the neighborhood of the welded portion in a state in which the contact member described later is mounted.

In this embodiment, the primary transfer device 5 includes a contact member 57 (FIG. 5) connected to the power source E1 for applying the voltage to the primary transfer brush 51 which is the brush-shaped electric power supplying member. Further, in this embodiment, the primary transfer brush 51 includes a welded portion 56 formed by heat aggregation of a part of the erected fiber portion 54. The contact member 57 is contacted to the welded portion 56.

Further, in this embodiment, at one longitudinal end portion of the erected fiber portion 54 of the primary transfer brush 51, the welded portion formed by heat aggregation of the electroconductive erected fibers of the erected fiber portion 54 is provided. Further, in this embodiment, a planar (electro)conductive member 57*a* which is a planar plate-like member as a part of the contact member 57 is surface-contacted to a welded surface 56*a*, of the welded portion 56, opposite from the base cloth portion 55. That is, the contact member 57 and the welded portion 56 are contacted to each other at a surface. In this embodiment, the contact member 57 is formed of metal. In this embodiment, a length X of the welded portion 56 with respect to the longitudinal direction of the primary transfer brush 51 is 2 mm. Further, a length Y of the welded portion 56 with respect to the short direction of the primary transfer brush 51 is 3 mm.

To the primary transfer brush 51, the high-voltage is applied, and therefore when the contact between the welded surface 56*a*, which constitutes an electric power supplying portion to the primary transfer brush 51, and the planar conductive member 57*a* is unstable, noise and electric discharge can occur. Therefore, at the welded portion 56, flexibility (surface following property) necessary to ensure good contact between the welded surface 56*a* and the planar conductive member 57*a* and electroconductivity are required.

In order to obtain the flexibility and the electroconductivity, the orientation density of the electroconductive erected fibers before the heat aggregation at the erected fiber portion 54 may preferably be 7.8 KF/cm$^2$ or more. As a result, a proportion of the electroconductive erected fibers per unit area of the welded portion 56 can be made in a suitable range.

As a means for forming the welded portion 56 by welding a part of the erected fiber portion 54, the following methods may be employed. For example, there is a method in which a blade or roller member using metal or the like is heated up to at least a temperature where the welding of the electroconductive erected fibers can be made and then is welded by being contacted and pressed against the erected fiber portion 54. Further, there is a method in which the blade or roller is vibrated at a high-frequency and then is welded by being contacted and pressed against the erected fiber portion 54. In this case, a manufacturing method of the electric power supplying device includes a step of forming the welded portion 56 by subjecting the part of the erected fiber portion 54 to the heat aggregation, and a step of bringing the contact member 57 into contact with the welded portion 56. However, any method may also be used if the method is capable of forming the welded portion 56 in contact with the contact member 57 by subjecting the part of the erected fiber portion 54 to the heat aggregation. After the above-described welding (process), in order to uniformize the shape of the welded portion, any process such as machining, polishing or cutting may also be performed.

By the above-described process, the electroconductive erected fibers of the erected fiber portion 54 are thermally aggregated as shown in FIG. 4, in a side opposite from the base cloth portion 55, the welded surface 56*a* which is macroscopically flat is formed. At this time, the heat aggregation of the electroconductive erected fibers is not always generated uniformly in a microscopic state, but a portion almost completely melded at the welded surface 56*a* forms a flat surface portion 56*b*, and a portion remaining in a fiber shape forms a projected portion 56*c* in some cases.

When the erected fiber portion 54 is heated, a phenomenon such that carbon black c as an electroconductive agent dispersed in the electroconductive erected fibers settles down can occur. Further, the carbon black c enters an inside of the welded portion 56 from the surface of the welded portion 56, so that local electric resistance non-uniformity can generate in the welded surface 56*a*. In this case, at the flat surface portion 56*b* in the welded surface 56*a*, the flexibility suitable for the contact can be easily obtained, but a degree of melting is high, and therefore the welded portion 56 is liable to have a high resistance due to the settling of the carbon black c. On the other hand, at an island portion 5*c* in the welded surface 56*a*, the settling of the carbon black is not readily generated, and therefore there is a tendency that original electroconductivity of the electroconductive erected fibers can be maintained.

However, to the welded surface 56*a* in such a state, the planar conductive member 57*a* is contacted din a surface-contact manner from a direction (normal direction) perpendicular to the welded surface 56*a* (the base cloth portion 55 and the fixing surface 52*a* of the supporting member 52). As a result, the planar conductive member 57*a* can contact the projected portion 56*c* where the settling of the carbon black c does not readily occur, and therefore good electrical contact can be obtained.

The planar conductive member 57*a* may preferably cover the welded surface 56*a* for the purpose of stably ensuring electric conduction between the welded surface 56*a* of the welded portion 56 and the planar conductive member 57*a*. For that reason, with respect to an area in which the welded surface 56*a* and the planar conductive member 57*a* oppose each other, the area of the planar conductive member 57*a* may preferably be larger than the area of the welded surface 56*a*. In other words, the contact member 57 may preferably have a surface, in the welded portion side, larger in area than a projected area of the welded portion 56.

Further, at the welded surface 56*a*, as described above, roughness (unevenness) by the flat surface portion 56*b* and the projected portion 56*c* exists in some cases. In the case where the contact member-side surface of the welded portion 56 has the unevenness, in order to obtain a reliable contact state, the contact member 57 may preferably contact the welded portion 56 in an entering amount larger than a height of the projected portion of the unevenness. In this case, the height of the projected portion of the unevenness can be represented by a surface roughness Rz (ten-point average roughness according to JIS). In other words, in order to obtain the reliable contact state, the planar conductive member 57*a* may preferably be caused to enter the welded portion 56 in the entering amount larger than the surface roughness Rz (ten-point average roughness according to JIS).

In this embodiment, as shown in FIG. 5, the contact member 57 specifically includes the following portions in addition to the planar conductive member 57*a* described above. First, the contact member 57 includes a sandwiching portion which is a flat plate-like member substantially parallel to and opposing the planar conductive member 57*a*. The contact member 57 further includes a connecting portion 57*c* for connecting the planar conductive member 57*a* and the sandwiching portion 57*b*. The sandwiching portion 57*b* contacts the surface, of the supporting member 52, in the side opposite from the side where the primary transfer brush 51 is fixed. A distance between the planar conductive member 57*a* and the sandwiching portion 57*b* is made smaller than the sum of thickness of the supporting member 52 and the primary transfer brush 51 (the base cloth portion 55 and the welded portion 56) which are disposed therebetween. As a result, end portions of the primary transfer brush 51 and the supporting member 52 are press-fitted into between the contact member 57*a* and the sandwiching portion 57*b*, so that the planar conductive member 57*a* can be contacted to the welded surface 56*a* and can enter the welded portion 56.

At least a part of the welded portion 56 is electrically connected with the electroconductive erected fibers of the erected fiber portion 54 which is not welded. In this embodiment, as shown in FIG. 5, the welded portion 56 is contacted to adjacent electroconductive erected fibers of the erected fiber portion 54 or is welded to the adjacent electroconductive erected fibers during the welding. As in this embodiment, in the case where the primary transfer brush 51 is of the pile fabric type, the part of the electroconductive erected fibers constituting the welded portion 56 is continuous to the adjacent electroconductive erected fibers of the erected fiber portion 54. Further, as described above, with respect to the longitudinal direction of the primary transfer brush 51, the electric power is supplied through the erected fiber portion 54 constituted by densely (tightly) disposing the electroconductive fibers.

6. Confirmation of Effect

The primary transfer brush 51 in this embodiment was incorporated in the image forming apparatus 100 in this embodiment, and then was used. As a result, it was confirmed that the electric power can be stably supplied from the side of the erected fiber portion 54 to the erected fiber portion 54 via the welded portion 56 and that also non-uniformity of application (electric power supply) of the primary transfer voltage to the primary transfer brush 51 is not generated and thus a good primary transfer performance can be obtained. As described above, according to this embodiment, the electric power can be stably supplied from the erected fiber portion side to the brush-shaped electric power supplying member, and as a fixing means for fixing the electric power supplying member to the supporting member, any fixing means including the double-side tape to which no electroconductivity is imparted can be used. Further, according to this embodiment, the fixing of the primary transfer brush 51 to the supporting member 52 was good, and the primary transfer brush 51 was not peeled off from the supporting member 52.

Further, in order to check the effect of the surface contact of the contact member 57 to the welded portion 56 in this embodiment, evaluation was made by using the image forming apparatus 100 in this embodiment. As Comparison Example 1, also the case where the same basic structure as the image forming apparatus 100 in Embodiment 1 is employed and a point contact-type contact used in general as the contact member for applying the voltage to the primary transfer brush 51 is used was evaluated. In each of Embodiment 1 and Comparison Example 1, the primary transfer brush 51 consisting of 100 fibers was incorporated in the image forming apparatus 100 and then an operation of the image forming apparatus 100 was checked. In the image forming apparatus 100 in Embodiment 1, in a normal state, a good image was obtained by applying a voltage of 350 V to the primary transfer brush 51. In each of Embodiment 1 and Comparison Example 1, the same voltage was applied to the primary transfer brush 51 and a 100%-density image of 50 mm-square was formed, and then the number of occurrences of density abnormality of the 100 fibers of the primary transfer brush 51 was checked. Further, in each of Embodiment 1 and Comparison Example 1, an electric resistance (under application of 100 V) between the contact member and the erected fiber portion 54 of the primary transfer brush 51 was measured, and a range thereof was checked. The results are shown in Table 1.

TABLE 1

| | DA* | CR*[2] |
|---|---|---|
| EMB. 1 | 0/100 | 1200-4800 Ω |
| COMP. EX. 1 | 76/100 | 1600-2 × $10^8$ Ω |

*1: "DA" is the density abnormality.
*[2]"CR" is the contact resistance (under application of 100 V).

As is understood from Table 1, in Embodiment 1, the contact resistance is stably low and thus a primary transfer current can be stably supplied, and therefore image defect did not generate. On the other hand, in Comparison Example 1, the contact resistance is very high, with the result that a sufficient primary transfer current cannot be supplied and thus the image defect generated in some cases.

As described above, it becomes possible to stably supply the electric power from the side of the erected fiber portion 54 to the primary transfer brush 51, so that the good image can be stably formed while maintaining the good primary transfer performance.

(Embodiment 2)

Another embodiment of the present invention will be described. Basic constitution and operation of an image forming apparatus in this embodiment are the same as those in Embodiment 1. Accordingly, elements having the same or corresponding functions and constitutions are represented by the same reference numerals or symbols and will be omitted from detailed description.

In this embodiment, when the welded portion 56 is formed at the part of the primary transfer brush 51, at the same time, the planar conductive member 57*a* of the contact member 57 is welded on the welded surface 56*a* of the welded portion 56. This is different from Embodiment 1.

Figure 6:
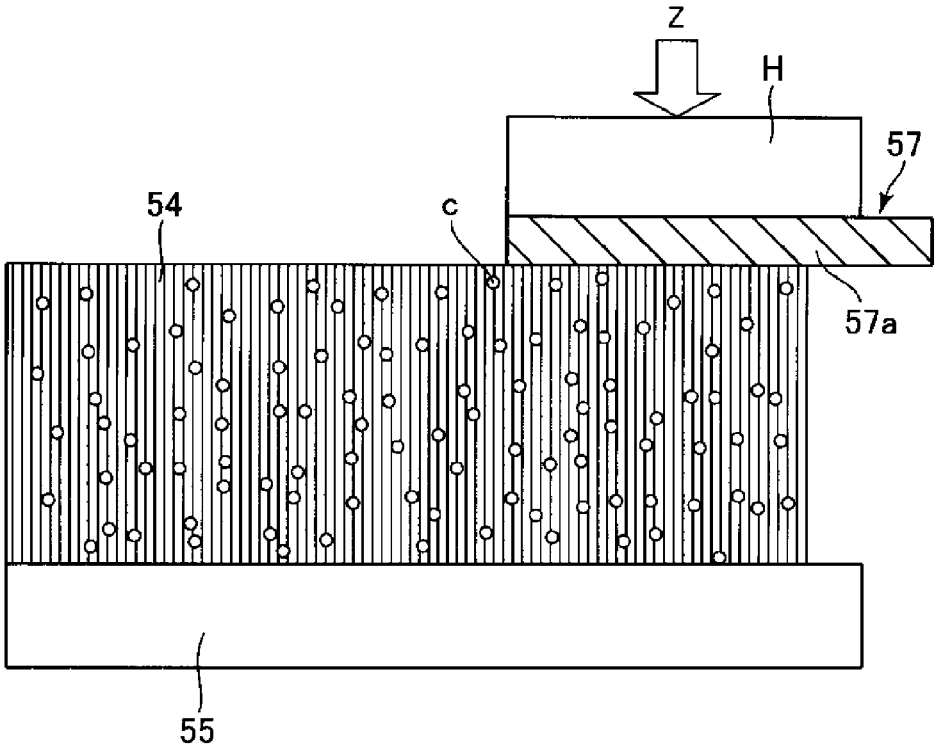
FIG. 6 is a schematic sectional view of an end portion of the primary transfer brush before the contact member is welded to a welded to a welding portion of the primary transfer brush.
Figure 7:
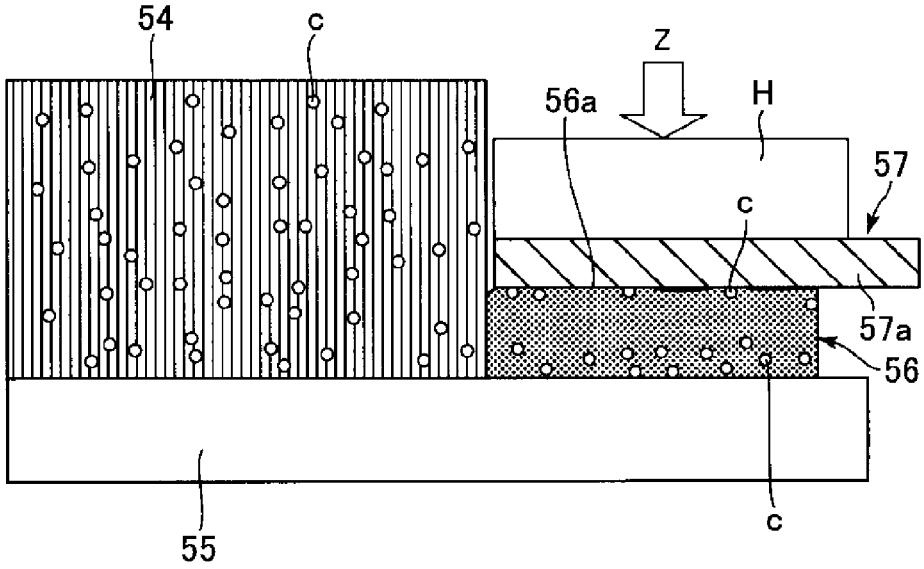
FIG. 7 is a schematic sectional view of the end portion of the primary transfer brush after the contact member is welded to the welding portion of the primary transfer brush.

As shown in FIG. 6, in this embodiment, at one longitudinal end portion of the erected fiber portion 54 of the primary transfer brush 51, the planar conductive member 57*a* of the contact member 57 constituted by metal is provided. Then, from above the planar conductive member 57*a* (from a side opposite from the primary transfer brush 51), the contact member 57 is pressed in an arrow H direction (toward the base cloth portion 55) while heating the planar conductive member 51*a* by a heater as a heating means. That is, the erected fiber portion 54 of the primary transfer brush 51 and the planar conductive member 57*a* can be closely contacted by (thermal) welding. As a result, an adhesive property between the welded surface 56*a* of the welded portion 56 and the planar conductive member 57*a* is increased, so that these portions can be surface-contacted to each other satisfactorily. In this case, a manufacturing method of the electric power supplying device includes the following steps. First, the manufacturing method includes a step of bringing the contact member 57 into contact with the part of the erected fiber portion 54. Further, the manufacturing method includes a step of urging the part of the erected fiber portion 54 via the contact member 57 while heating the part of the erected fiber portion 54 to form the welded portion 56 by heat aggregation of the part of the erected fiber portion 54 and of welding the contact member 57 on the welded portion 56.

Therefore, according to this embodiment, an effect similar to that in Embodiment 1 can be obtained and in addition, it is possible to stably ensure the electric conduction between the welded surface 56*a* of the welded portion 56 and the planar conductive member 57*a* compared with Embodiment 1. As a result, the good image can be stably formed while maintaining the good primary transfer performance.

Further, in this embodiment, the adhesive property between the welded surface 56*a* of the welded portion 56 and the planar conductive member 57*a* is increased, so that even when the area of the planar conductive member 57*a* is not made larger than the area of the welded portion 56, it is possible to further stably ensure the electric conduction. As a result, the area of the planar conductive member 57*a* can be reduced, so that it becomes possible to reduce a cost and a size. Also in this embodiment, as desired, the area of the planar conductive member 57*a* may be made larger than the area of the welded portion 56.

(Other Embodiments)

In the above, the present invention is described based on the specific embodiments but is not limited to Embodiments 1 and 2.

For example, in Embodiments 1 and 2, as the brush-shaped electric power supplying member, the brush member of the pile fabric type is used, but the electric power supplying member is not limited thereto. For example, a brush member of an electrostatic fiber-planted type may also be used. The pile fabric is formed by weaving pile yarn, constituting the brush fibers, at a gap of the base cloth consisting of warp and welt. Further, the electrostatic fiber planting is a method in which the brush member is formed by, e.g., substantially vertically anchoring short fibers, constituting the brush fibers, on a substrate on which an adhesive is applied in advance by utilizing an electrostatic attraction force in a high-voltage electrostatic field.

Further, as described above, in order to simply and firmly fix the brush-shaped electric power supplying member, the brush-shaped electric power supplying member may preferably be fixed on the supporting member by the normal double-side tape to which no electroconductivity is imparted, but the fixing means is not limited thereto. As described above, according to the present invention, the electric power can be stably supplied from the side of the erected fiber portion to the erected fiber portion, and therefore the brush-shaped electric power supplying member can be fixed on the supporting member by any fixing means including the double-side tape to which no electroconductivity is imparted. As the fixing means, as desired, it is also possible to use an electroconductive double-side tape, and it is also possible to use an adhesive, other than the double-side tape. In this case, the adhesive to which no electroconductivity is imparted may also be used.

Further, as described above, the fibers of the base cloth portion of the brush-shaped electric power supplying member may preferably be non-electroconductive, but are not limited thereto. The fibers of the base cloth portion may also have electroconductivity as desired. In the case where the base cloth portion is constituted by the electroconductive erected fibers or in the case where the base cloth portion is impregnated with an electroconductive resin material (adhesive), the electric power may be supplied to the brush-shaped electric power supplying member with respect to the longitudinal direction via the base cloth portion in addition to or in place of the erected fiber portion.

Further, in Embodiments 1 and 2, the constitution in which the brush-shaped electric power supplying member has the predetermined length with respect to each of the longitudinal direction and the short direction substantially perpendicular to the longitudinal direction, and the welded portion is provided at one of the longitudinal end portions was employed. However, the constitution is not limited thereto, but the welded portion may also be provided at both of the longitudinal end portions of the brush-shaped electric power supplying member. That is, the electric power supplying member can be constituted so as to include the welded portion provided at at least one of the longitudinal end portions. Further, as desired, the welded portion may also be provided at a part of a portion (e.g., a central portion), other than the longitudinal end portions, in addition to or in place of one or both of the longitudinal end portions of the brush-shaped electric power supplying member.

Further, in Embodiments 1 and 2, the electric power supplying device is the primary transfer device, but is not limited thereto. The present invention is also applicable to other electric power supplying devices, so that the high-voltage can be stably supplied similarly as in Embodiments 1 and 2, and thus functions corresponding to the associated electric power supplying devices can be improved.

As an example, an image forming apparatus 100 employing a cleaning device (brush) 600 as the electric power supplying device will be described with reference to FIG. 8. The image forming apparatus in FIG. 8 is the same as the image forming apparatus in FIG. 1 except that the cleaning device 600 is used in place of the belt cleaner 66, and therefore the same constituent elements will be described using the reference numerals or symbols in FIG. 1.

Figure 8:
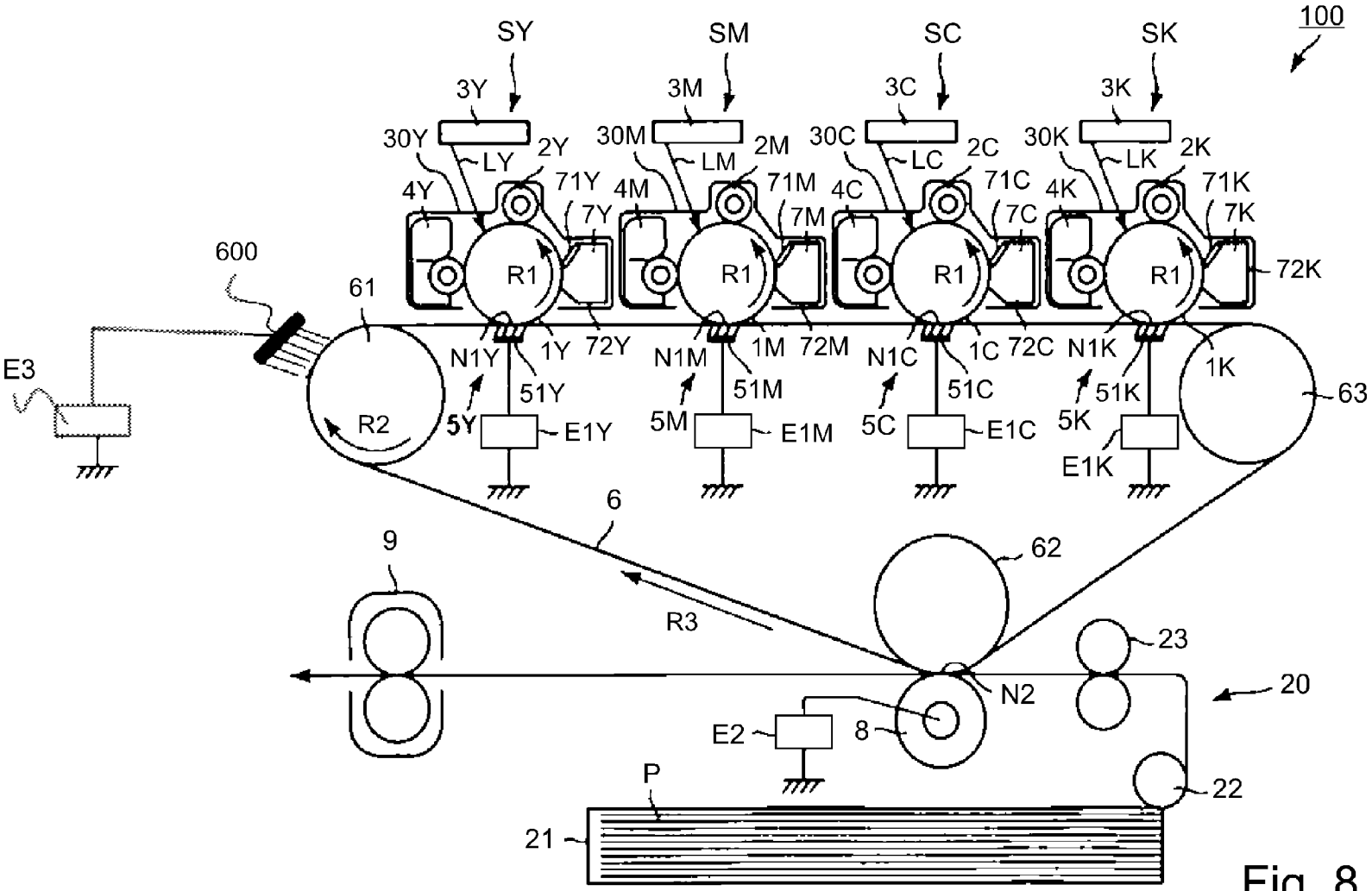
FIG. 8 is a schematic sectional view of another image forming apparatus.

In the image forming apparatus in FIG. 8, the transfer residual toner on the intermediary transfer belt 6 is electrically charged by the cleaning brush 600 which is the cleaning device. Specifically, the voltage of the opposite polarity to the normal toner polarity is applied from a high-voltage source E3 to the cleaning brush 600. The transfer residual toner charged to the opposite polarity is collected from the intermediary transfer belt 6 onto the photosensitive drum 1 at the primary transfer nip.

The cleaning brush 600 employs the same constitution as the constitution of the primary transfer device 5, so that even in the constitution in which the intermediary transfer belt 6 is rubbed with the cleaning brush 600 at the outer peripheral surface of the intermediary transfer belt 6, the voltage can be stably applied by providing the welded portion in the cleaning brush 600.

As the electric power supplying device described above, the following devices can be used. The electric power supplying device may include, e.g., a charging device for charging the image bearing member for bearing the toner image, a transfer device for transferring the toner image from the image bearing member onto the transfer-receiving member, a toner charging device for supplying the electric charges onto the image bearing member, a cleaning device for removing the toner remaining on the image bearing member, and a charge-removing device for removing the electric charges from the image bearing member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 224716/2013 filed Oct. 29, 2013, which is hereby incorporated by reference.

What is claimed is:

1. An image forming apparatus comprising:

an image bearing member for bearing a toner image;

a belt for transferring the toner image from said image bearing member onto a transfer material;

an electric power supplying device contacting said belt, to which a voltage is to be applied, wherein said electric power supplying device includes an erected fiber portion formed with a plurality of electroconductive erected fibers contacted to said belt;

a power source; and a contact member connected to said electric power supplying device, for applying the voltage from said power source to said electric power supplying device, wherein said electric power supplying device includes a welded portion formed by heat aggregation of a part of said erected fiber portion, and said contact member includes a contact portion contacting and opposing said welded portion in a state in which a voltage is applied from said power source to the contact portion.

2. An image forming apparatus according to claim 1, wherein said contact member has a contact surface, and said welded portion has a surface-to-be-contacted contactable with the contact portion.

3. An image forming apparatus according to claim 2, wherein said contact member has the contact portion, in a welded portion side, having a larger area than a projected area of said welded portion.

4. An image forming apparatus according to claim 3, wherein the surface-to-be-contacted has projections and recesses, and said contact member contacts said welded portion with a penetration amount larger than a height of the projections.

5. An image forming apparatus according to claim 2, wherein said contact member is welded to said welded portion.

6. An image forming apparatus according to claim 1, further comprising a supporting member for supporting said electric power supplying device, wherein said electric power supplying device includes a supporting portion for supporting said erected fiber portion, and said supporting portion is bonded to said supporting member by a double-side tape to which electroconductivity is not imparted.

7. An image forming apparatus according to claim 6, wherein said supporting portion is a base cloth portion formed with non-electroconductive fibers.

8. An image forming apparatus according to claim 6, wherein said supporting member is an insulating member to which electroconductivity is not imparted.

9. An image forming apparatus according to claim 6, wherein said contact member includes said contact portion contacting said welding portion and a sandwiching surface for sandwiching said electric power supplying device in contact with said supporting member.

10. An image forming apparatus according to claim 9, wherein said contact member is formed of metal.

11. An image forming apparatus according to claim 1, wherein said electric power supplying device has a predetermined length with respect to a longitudinal direction perpendicular to a movement direction of said belt and a predetermined length with respect to a short direction parallel to the movement direction of said belt, and the predetermined length with respect to the longitudinal direction is longer than the predetermined length with respect to the short direction.

12. An image forming apparatus according to claim 11, wherein said electric power supplying device includes said welded portion only at one end portion thereof with respect to the longitudinal direction.

13. An image forming apparatus according to claim 1, wherein said belt is an endless belt and said electric power supplying device slides with an inner peripheral surface of said belt to transfer the toner image from said image bearing member onto said belt.

14. An image forming apparatus according to claim 1, wherein said belt is an endless belt, and said electric power supplying device sides with an inner peripheral surface of said belt to electrically charge a toner on said belt.

15. An image forming apparatus according to claim 1, wherein said contact member sandwiches said electric power supplying device.

* * * * *